US007841048B2

(12) United States Patent
Tsai

(10) Patent No.: US 7,841,048 B2
(45) Date of Patent: Nov. 30, 2010

(54) SLIDING ASSEMBLY HAVING A BODY FOR TRANSVERSAL SLIDING DOOR

(75) Inventor: Dong-Shiuan Tsai, Taichung (TW)

(73) Assignee: Door & Window Hardware Co., Taichung (TW)

( * ) Notice: Subject to any disclaimer, the term of this patent is extended or adjusted under 35 U.S.C. 154(b) by 364 days.

(21) Appl. No.: 12/108,523

(22) Filed: Apr. 24, 2008

(65) Prior Publication Data

US 2009/0265886 A1 Oct. 29, 2009

(51) Int. Cl.
*E05D 15/00* (2006.01)

(52) U.S. Cl. ..... 16/91; 16/97; 16/107

(58) Field of Classification Search ..... 16/91, 16/97, 102, 107, 106, 87.6 R, 87.2, 87 R, 16/87.4 R; 49/409, 410, 411, 412; 384/531, 384/532, 58, 59, 18, 19, 540, 542, 55, 547; 301/1, 111.01, 111.06, 5.1, 5.23, 5.309, 5.7
See application file for complete search history.

(56) References Cited

U.S. PATENT DOCUMENTS 2,392,633 A * 1/1946 Bierman ..... 301/5.7
2,476,193 A * 7/1949 Hirschmugl ..... 301/5.7
3,072,169 A * 1/1963 Hastings, Jr. ..... 152/41
3,469,892 A * 9/1969 Langstroth ..... 384/18
3,553,765 A * 1/1971 Frost ..... 16/107
4,798,149 A * 1/1989 Hoffmann ..... 105/155
5,070,575 A * 12/1991 Redman et al. ..... 16/96 R
6,390,680 B1 * 5/2002 Last ..... 384/55
7,637,059 B2 * 12/2009 Chang et al. ..... 49/425
7,698,781 B2 * 4/2010 Cai ..... 16/87.2

FOREIGN PATENT DOCUMENTS

DE 10219184 A1 * 11/2003
JP 2001024044 A * 1/2001
WO WO 0236916 A1 * 5/2002

* cited by examiner

*Primary Examiner*—Chuck Y. Mah

(57) ABSTRACT

A sliding assembly having a body for a transversal sliding door includes a positioning unit and a sliding device. One end of the positioning unit serves to assemble with a doorplate; and another end thereof serves to assemble with the sliding device. The sliding device includes a retaining portion and a rolling portion. The rolling portion includes a first combining portion, a second combining portion, a wheel shaft and a contact unit. The contact unit is clampingly and sandwichedly disposed between the first and second combining portion. Of the wheel shaft; and the wheel shaft is rotatably engaged with the retaining seat and is received in the first combining portion. Thereby when the doorplate is pushed, the contact unit will suffer from a force so that the rolling portion will pivotally rotate with respect to the retaining portion so that the doorplate can move transversally.

10 Claims, 11 Drawing Sheets

SLIDING ASSEMBLY HAVING A BODY FOR TRANSVERSAL SLIDING DOOR

FIELD OF THE INVENTION

The present invention relates to doors, and particularly to a sliding assembly having a body for a transversal sliding door which provides a transversal movement function to the doorplate and can retain the doorplate without turnover and the assembly can be assembled to match the thickness of the doorplate.

BACKGROUND OF THE INVENTION

Generally, a door is operated by pushing or pulling. A lateral side of a door is hinged to a doorframe. The door is opened by a pushing force. However in pushing the door, a front side of the door must leave a greater space for operation. If the space is small, it is difficult to install the door and the doorplate is difficult to be opened due to the limitation of the space, or the opening of the door is limited, even the doorplate will collide with other objects. Thus, transversal movement doorplates are developed for resolving above difficulty in the prior art.

Referring to U.S. Pat. No. 5,301,468, "Sliding door", a prior art door is disclosed in that patent. In the prior art, an upper side of each of two doorplates is installed with a sliding unit. The sliding unit includes a retaining seat and a movable seat. The retaining seat is retained to the doorplate. The retaining seat is formed with a protruded track and a recessed track. The moveable seat is assembled to another doorplate. Each of an upper side and a lower side of the movable seat is installed with a pulley set. The pulley sets are installed to the protruding track and the recessed track so that the moveable seat is slideable with respect to the retaining seat. Thus the doorplate with the moveable seat is moveable transversally with respect to another doorplate.

However although this prior art transversal doorplate may be opened or closed transversally, its structure is very complicated. Furthermore, in the installation thereof, one side of the sliding unit will be over the doorplate with a great size. As a result, the doorplate with the moveable seat has a center of gravity which is shifted to an outer side of the doorplate and thus is distanced to a vertical central line of the doorplate. Therefore, as the connection of the retaining seat and the doorplate is used as a fulcrum, the greater the center of gravity of another doorplate shifted from the central portion, the greater the torque from the weight of the doorplate so that the pressure applied to the protruding track at an upper side of the doorplate is greater. As a result, the burden to the retaining seat is increased. The user will feel a resisting force existed as the user pulls the doorplate. Furthermore, it is possible that the doorplate will turn over. Thus it is unsafe and unbeautiful. Furthermore, to have a beautiful outlook, more and more glass doorplates are used to replace wood doorplate, but glass is heavy than wood so that as glass doorplate will increase the possibility that the doorplate turnovers. Furthermore, the sizes of the retaining seat and the moveable seat are fixed. They are not matched to doorplates of different thicknesses. A sliding device is only suitable for a doorplate of a single thicknesses. Thus it is not practical and necessary to be improved.

SUMMARY OF THE INVENTION

Accordingly, the object of the present invention is to provide a sliding assembly for a transversal sliding door, as comparing with the prior art doorplate, it is more difficult to turn over, and can be assembled with the thickness of the doorplate.

To achieve above object, the present invention provides a sliding assembly having a body for a transversal sliding door, the body comprising a positioning unit and a sliding device.

One end of the positioning unit serves to assemble with a doorplate by using two clamping units and the positioning unit is parallel to the doorplate. The positioning unit may be a doorplate and the sliding device of the body is directly assembled to the doorplate. The sliding device is installed to another end of the positioning unit so that when the doorplate is pushed. The sliding device will rotate with respect to the doorplate freely so that the doorplate can displace transversally.

The sliding device includes a retaining portion and a rolling portion. The retaining portion is combined to the positioning unit and the rolling portion is pivoted to the retaining portion. Thereby the rolling portion is rotatable with respect to the retaining portion.

The retaining portion includes a retaining unit and a retaining seat. The retaining unit is assembled to the doorplate at a side opposite to the side combined with the positioning unit. The retaining seat is assembled to the side that the doorplate at the side that the doorplate installed to the positioning unit. The retaining unit passes through the positioning unit to screw to the retaining seat. The rolling portion is rotatably positioned to the retaining seat. Thereby the retaining portion is combined to the rolling portion and the positioning unit.

The rolling portion includes a first combining portion rotatably engages with the retaining seat. A wheel shaft rotatably engages with the retaining seat and is received in the first combining portion. The wheel shaft has a through hole axially defined therein. A second combining portion threadedly engages with the first combining portion. A contact unit is clampingly and sandwichedly disposed between the first combining portion and the second combining portion. A retaining rod extends from one end of the retaining seat. The retaining rod passes through the through hole of the wheel shaft. A buckle is assembled to a distal end of the retaining rod so as to limit the wheel shaft on the retaining rod; thus the rolling portion will pivot to the retaining seat by the wheel shaft. The rolling portion is vertically aligned with the doorplate. Since the positioning unit is parallel to the doorplate so that after the body is combined to the doorplate, the center of the gravity will retains to a vertical central line of the doorplate and thus it is difficult to turn over.

Besides, other than the function of transversal movement, to make the rolling portion is more flexible to match an object to be installed. In the present invention, the first combining portion is screwed to the second combining portion and the contact unit is clamped therebetween. An outer edges of the first combining portion and second combining portion protrudes out of each side of the contact unit so that the outer edges of the first combining portion and the second combining portion clamp to each other; and thus the rolling portion can adjust the distance between the first combining portion and the second combining portion based on the object to be installed thereto. An outer side of the second combining portion is installed with two tightening units which passes through the second combining portion. This the distance between the first combining portion and the second combining portion is adjusted. The tightening units will be controlled to resist against the lateral sides of the first combining portion and the contact unit so as to prevent the second combining portion from falling out.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
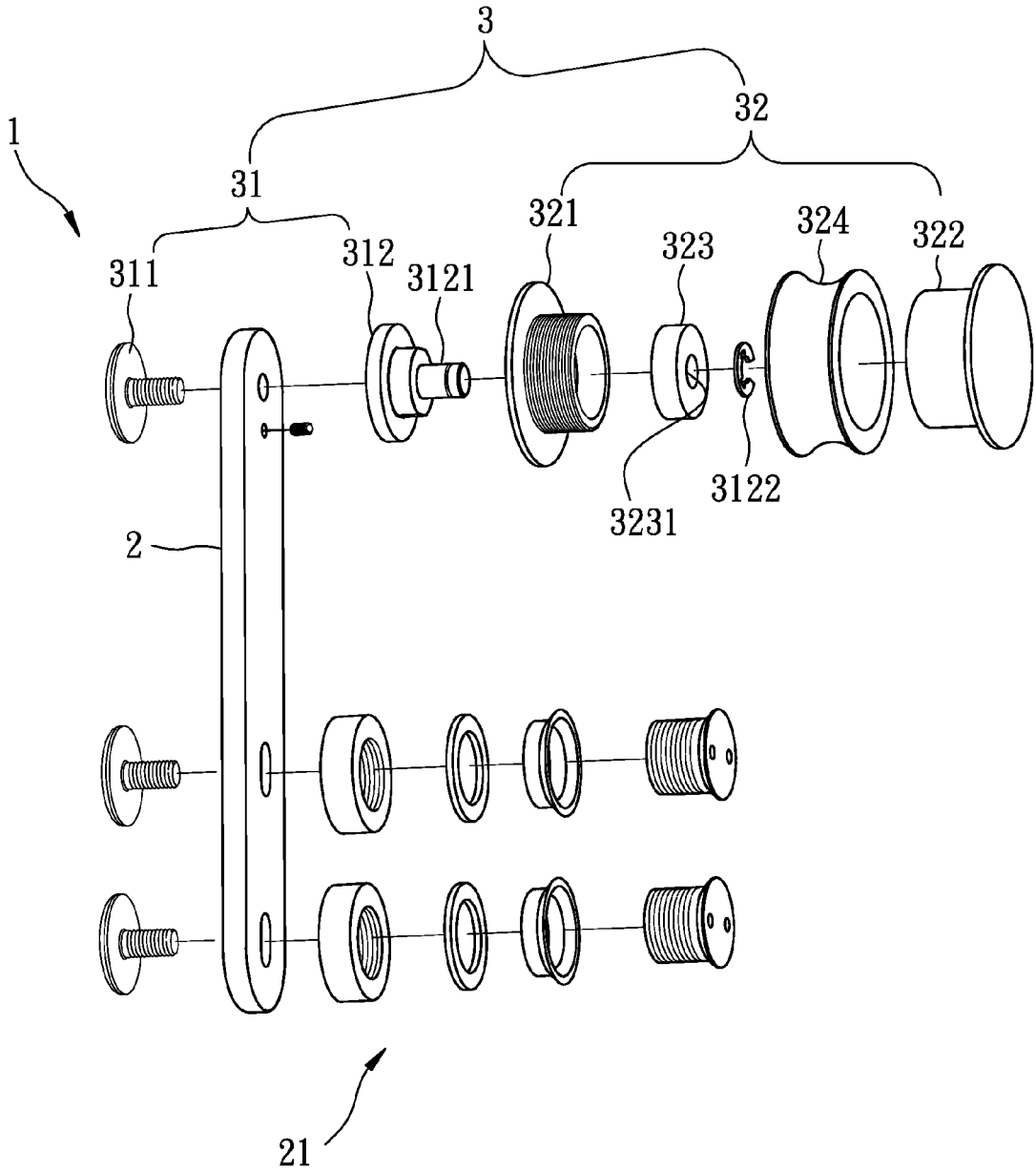
FIG. 1 is an explosive schematic view showing elements of the sliding assembly for a transversal sliding door of the present invention.

The present invention relates to a sliding assembly for a transversal sliding door, as illustrated in FIG. 1. The body 1 of the present invention includes a positioning unit 2 and a sliding device 3.

The positioning unit 2 has a long shape. One end thereof is installed with two clamping units 21 for clamping a doorplate. Thereby one side of the positioning unit 2 is combined to the doorplate and the positioning unit 2 is parallel to a surface of the doorplate. Or the positioning unit 2 may be a doorplate and in the body 1 of the present invention, the sliding device 3 is directly assembled to a doorplate; and the sliding device 3 is assembled to another end of the positioning unit 2. Thereby when the doorplate is pushed, the sliding device 3 is rotatable freely with respect to the positioning unit so that the doorplate can move transversally.

The sliding device 3 includes a retaining portion 31 and a rolling portion 32. The retaining portion 31 is combined to the positioning unit 2 and the rolling portion 32 is rotatably assembled with the retaining portion 31. Thereby the rolling portion 32 is rotatable with respect to the retaining portion 31.

The retaining portion 31 includes a retaining unit 311 and a retaining seat 312 for assembling with the rolling portion 32. The retaining seat 312 is secured with the retaining unit 312. The retaining unit 311 is assembled to the doorplate at a side opposite to the side combined with the positioning unit 2. The retaining seat 312 is assembled to the side that the doorplate at the side that the doorplate installed to the positioning unit 2. The retaining unit 311 passes through the positioning unit 2 to screw to the retaining seat 312. The rolling portion 32 is rotatably engaged with the retaining seat 312. Thereby the retaining portion 31 is combined to the rolling portion 32 and the positioning unit 2.

The rolling portion 32 includes a first combining portion 321 having an outer thread formed in one end thereof, the first combining portion 321 rotatably engages with the retaining seat 312. A second combining portion 322 having an inner thread formed in one end thereof and corresponding to the outer thread of the first combining portion 321 for threadedly engaging with the first combining portion 321. A wheel shaft 323 is rotatably engaged with the retaining seat 312. The wheel shaft 323 is received in the first combining portion 321. The wheel shaft 323 has a through hole 3231 axially defined therein. A contact unit 324 is clampingly and sandwichedly disposed between the first combining portion 321 and the second combining portion 322. The contact unit 324 is a hollow annular block. When the contact unit 324 is disposed between the first combining portion 321 and the second combining portion 322, an outer edge of the contact unit 324 is parallel to outer edges of the first combining portion 321 and second combining portion 322. Besides, a retaining rod 3121 extends from one end of the retaining seat 312 for passing through the through hole 3231 of the wheel shaft 323. Thereby when the rolling portion 32 is combined to the retaining seat 312, the retaining rod 3121 will pass through the through hole 3231 of the wheel shaft 323 and a buckle 3122 is assembled to a distal end of the retaining rod 3121 so as to limit the wheel shaft 323 on the retaining rod 3121. Thereby by the wheel shaft 323, the rolling portion 32 is rotatable with respect to the retaining seat 312 and is limited by the buckle 3122 without falling out of the retaining seat 312. Furthermore, since the rolling portion 32 is vertically aligned with the doorplate combining with the positioning unit 2 and the positioning unit 2 is parallel to a surface of the doorplate so that after the body 1 is combined to the doorplate, the gravitational center thereof is retained to a vertical central line of the doorplate. This it will not turnover.

Figure 2:
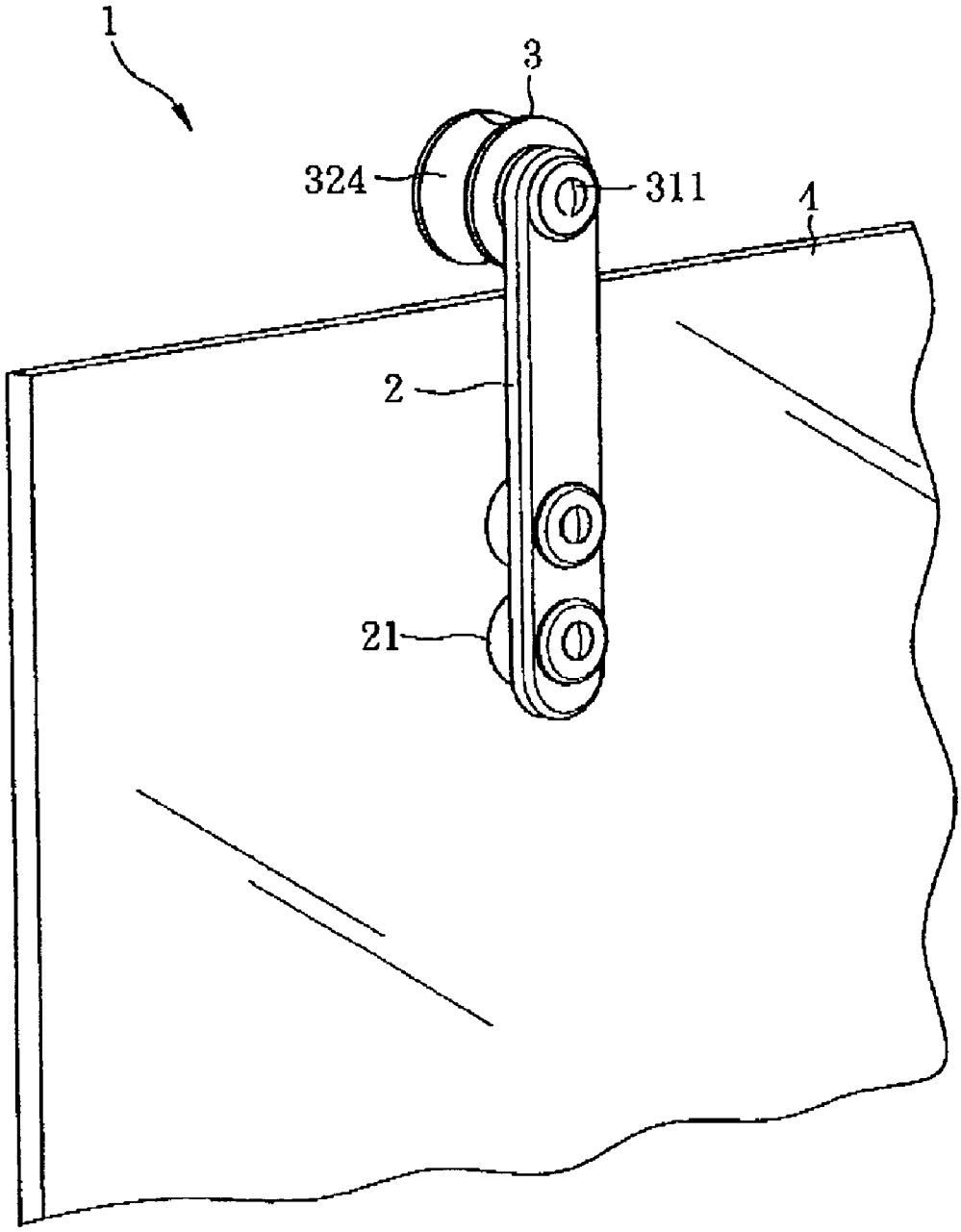
FIGS. 2, 3 and 4 are schematic views showing the installation and operation of the sliding assembly for a transversal sliding door of the present invention.
Figure 4:
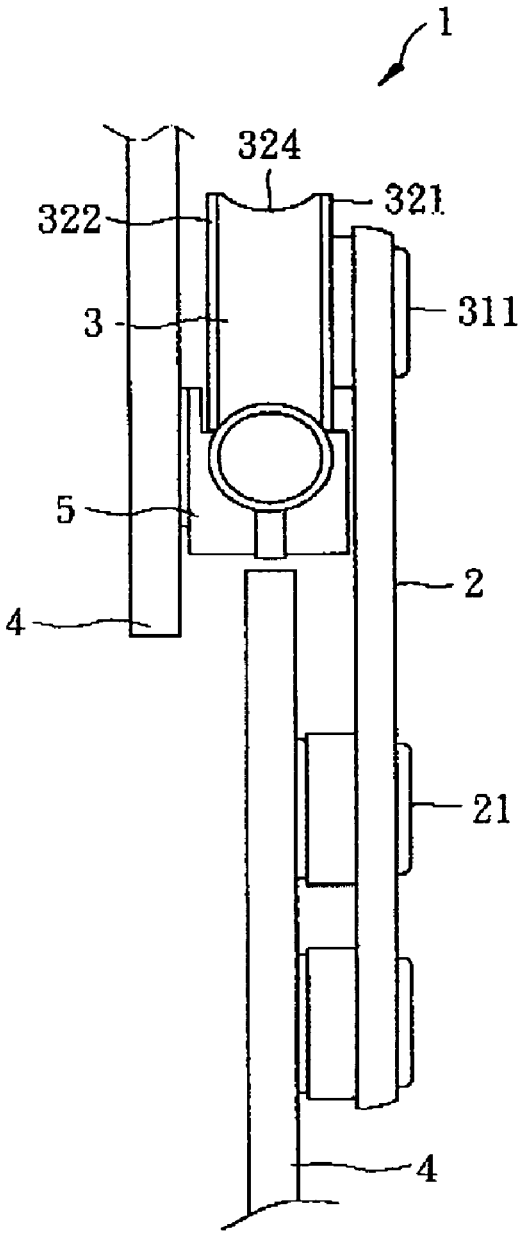
Figure 3:
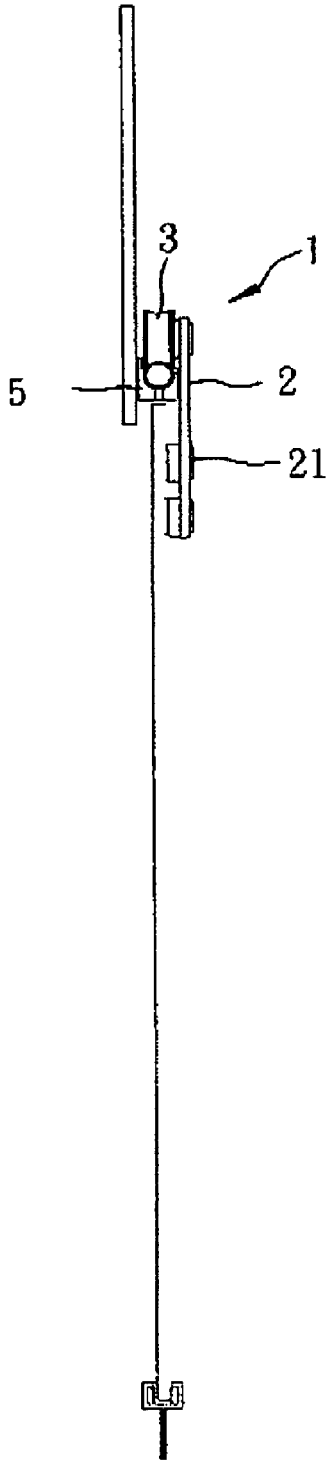

Referring to FIGS. 2 to 4, in use of body 1 of the present invention, the two clamping units 21 at one end of the positioning unit 2 will clamp a glass doorplate 4 so that the body 1 is combined and fixed to the glass doorplate 4. The contact unit 324 of the rolling portion 32 is rollably installed to a track device 5. The track device 5 is assembled to an upper end of another glass doorplate 4. Thereby when the glass doorplate 4 with the body 1, the contact unit 324 is compressed indirectly, so that the rolling portion 32 slides with respect to the track device 5. As a result, the glass doorplate 4 with the body 1 will move transversally with respect to another glass doorplate 4 so as to have the function of saving space. By the assembly of the sliding device 3 and the body, the glass doorplate 4 will not turnover.

Figure 5:
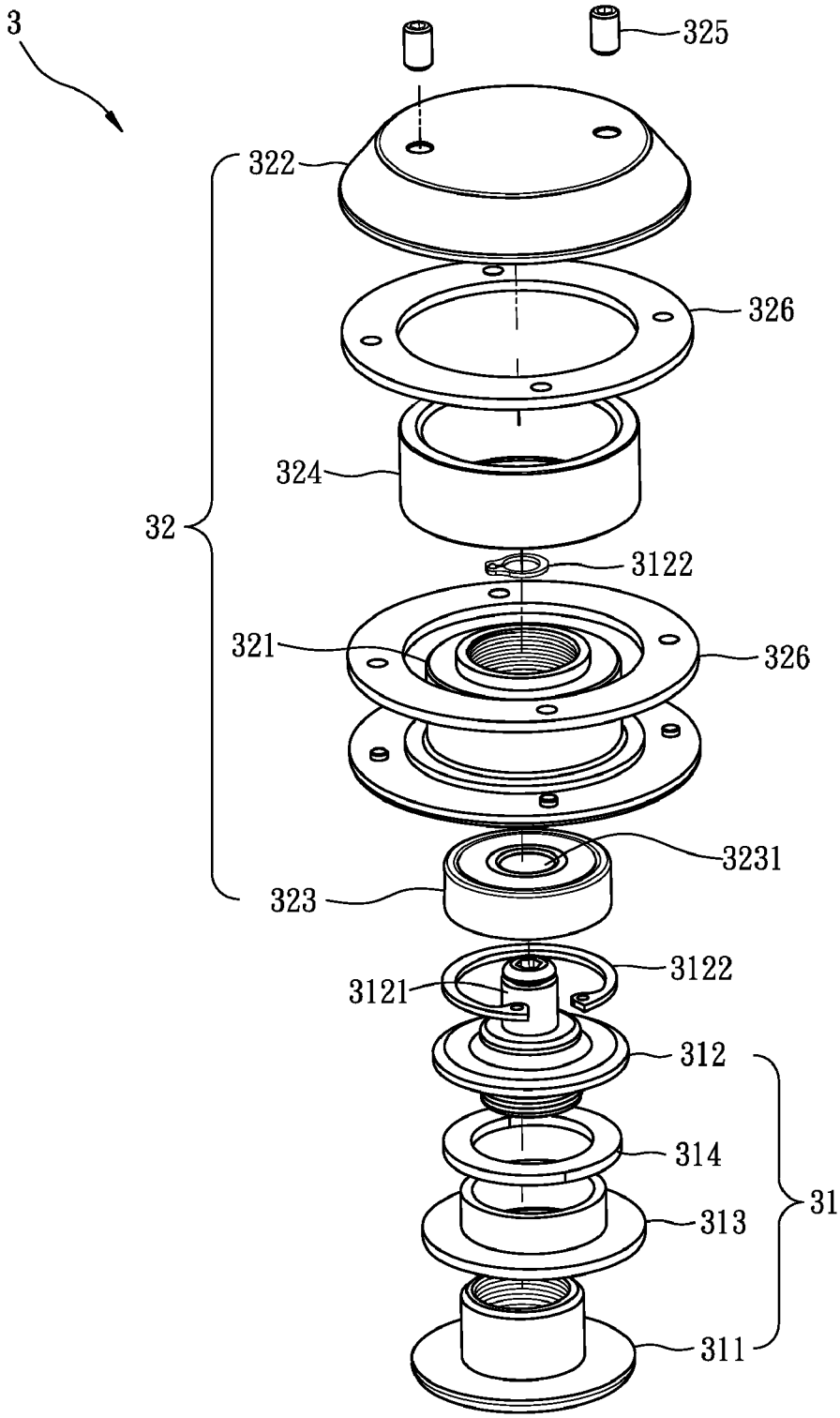
FIG. 5 is a structural schematic view about the adjustment of the clamping distance of the Sliding assembly for a transversal sliding door of the present invention.
Figure 6:
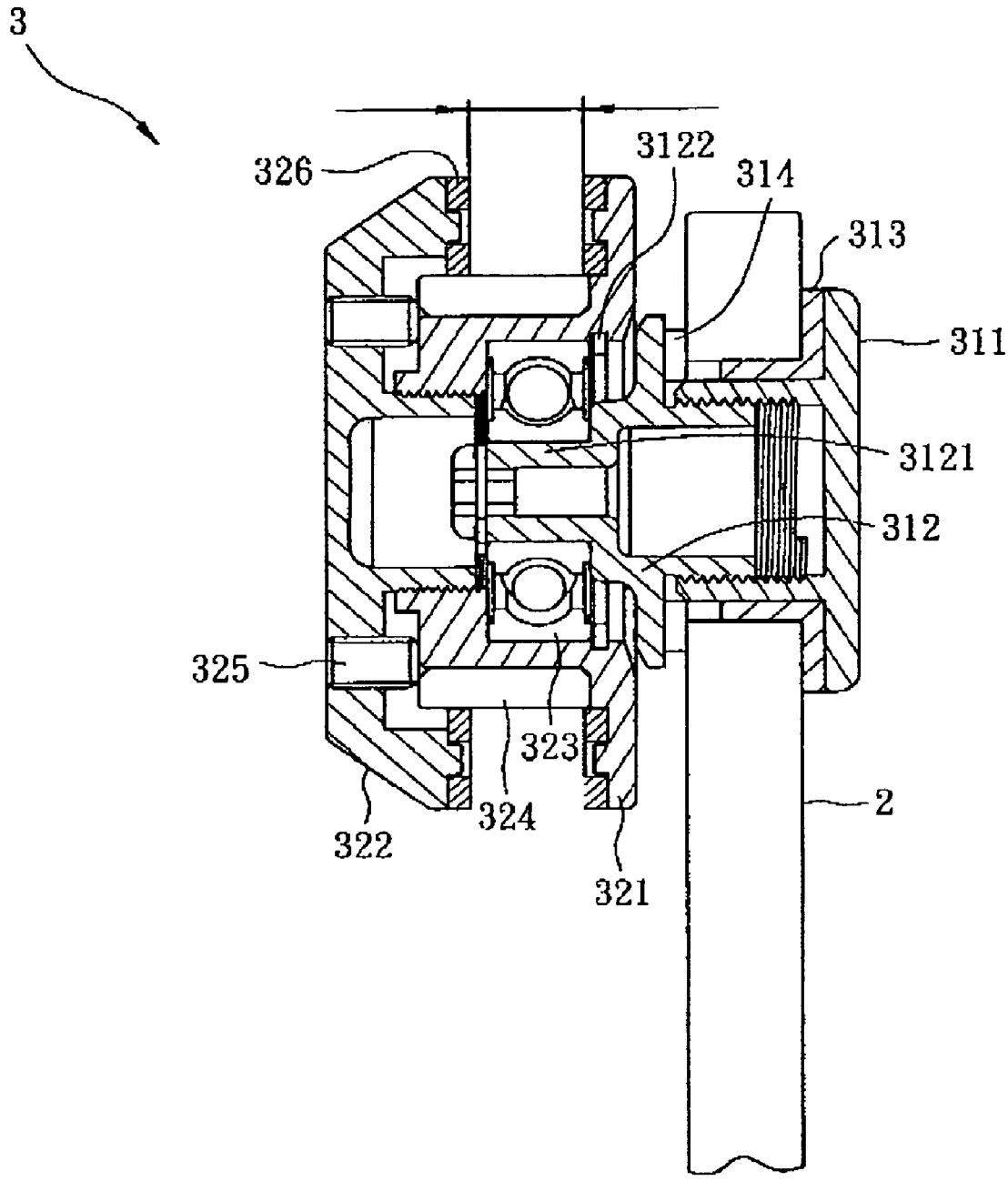
FIGS. 6, 7, 8 and 9 are schematic views about the installation and operation of the adjustment of clamping distance in the sliding assembly for a transversal sliding door of the present invention.
Figure 7:
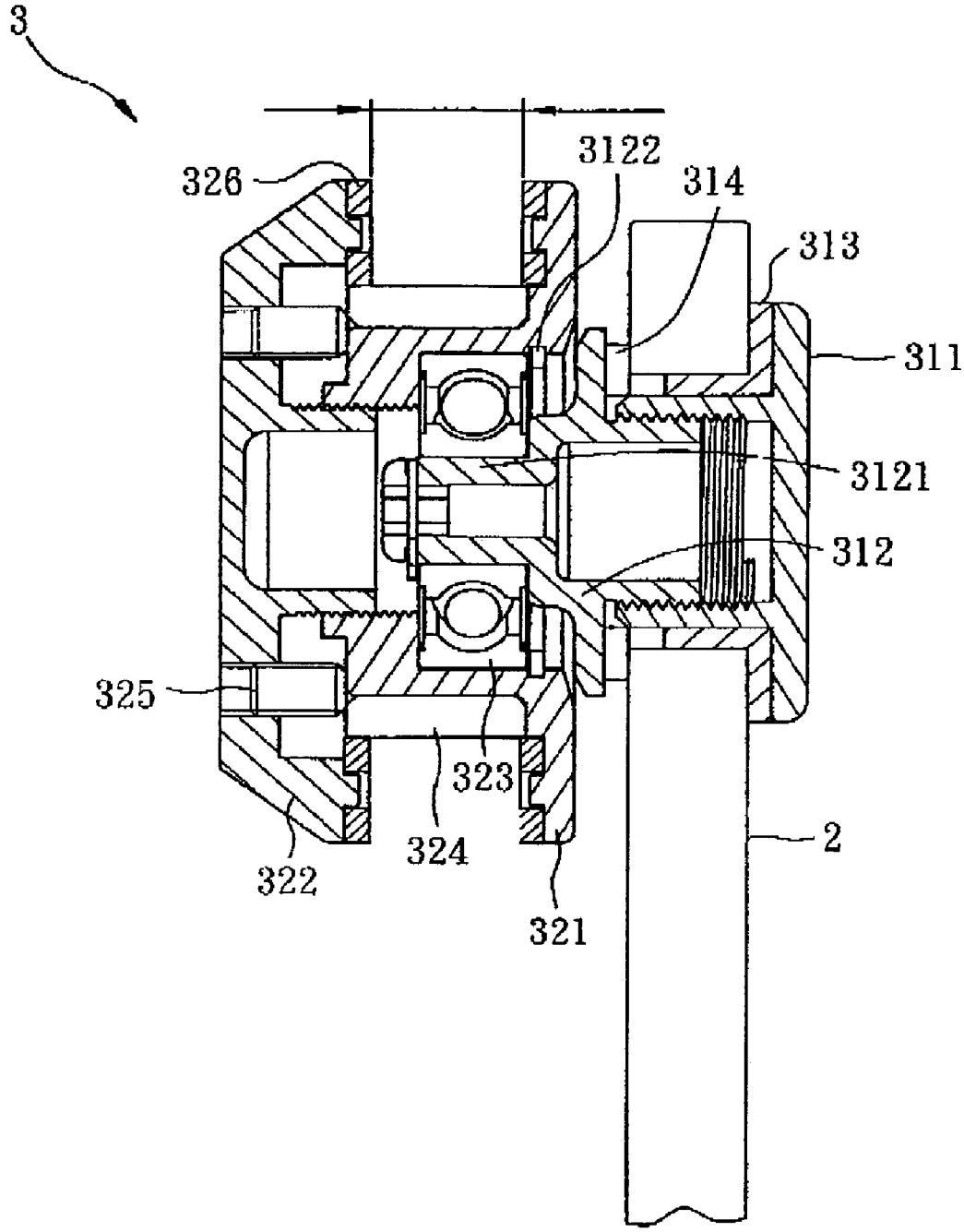
Figure 8:
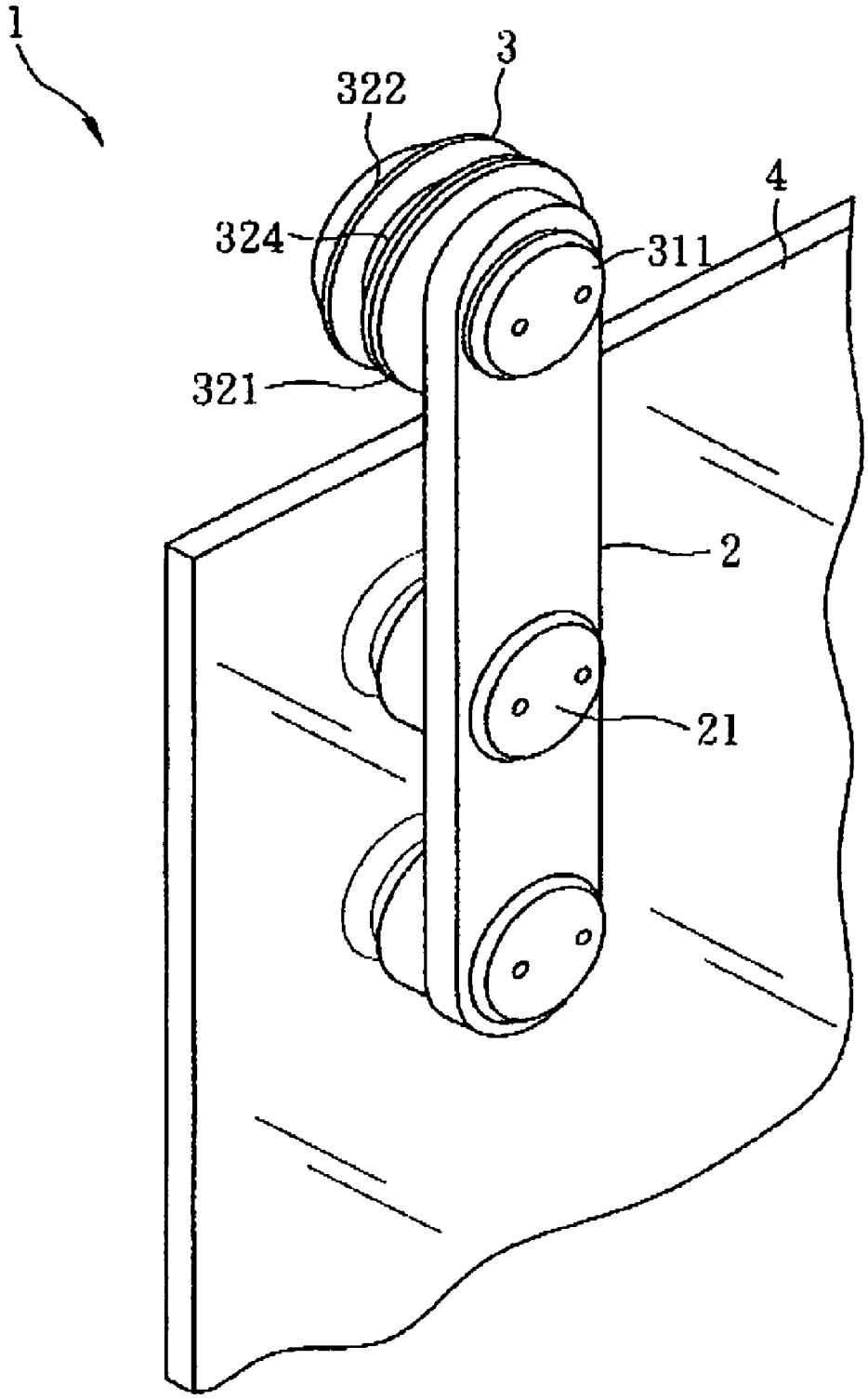
Figure 9:
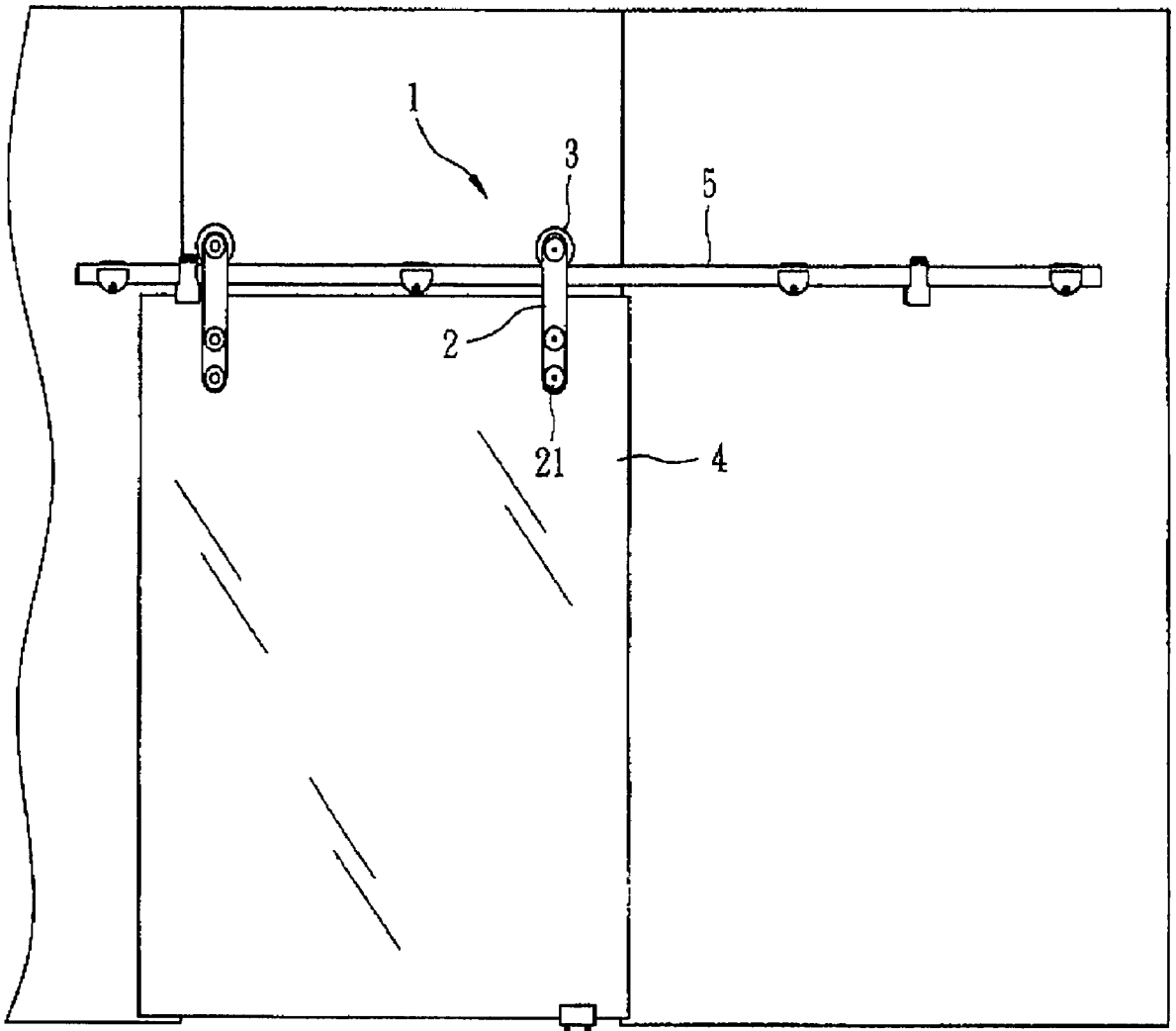

Besides, other than the function of transversal movement, to promote the application of the rolling portion 32 with an object to assembly therewith, the present invention provides another kind of sliding device 3, as shown in FIG. 5, an auxiliary clamping unit 313 and a pad 314 is installed between the retaining unit 311 and the retaining seat 312 of the sliding device 3. When the retaining unit 311 and the retaining seat 312 are clamped at two sides of the positioning unit 2, the auxiliary clamping unit 313 and the pad 314 will clamp the two sides of the position unit 2, and this will enhance the stability in clamping and one side of the retaining unit 311 is horizontal. Moreover, the auxiliary clamping unit 313 has a shape corresponding to that of the retaining unit 311. Thus, in assembling the retaining unit 311 and the positioning unit 2, it is clamped at an outer side of the positioning unit 2.

When an upper end and a lower end of the retaining rod 3121 of the retaining seat 312 are installed with respective buckles 3122, and the wheel shaft 323 is assembled inside the first combining portion 321, one buckle 3122 will resist against an inner wall of the first combining portion 321 and another buckle will combine with the retaining rod 3121. Thereby the wheel shaft 323 is limited to the retaining rod 3121 and the first combining portion 321.

The first combining portion 321 is screwed to the second combining portion 322, while the contact unit 324 is assembled therebetween. Each diameter of the first combining portion 321 and the second combining portion 322 is larger than that of the contact unit 324. Thus, the first combining portion 321 and the second combining portion 322 will clamp to each other, such that the first combining portion 321 and the second combining portion 322 are screwedly and clampingly engaged; thus a distance between the first combining portion 321 and the second combining portion 322 is adjustable based on a size of the contact unit 324. Two tightening units 325 pass through the second combining portion 322. When adjusting the distance between the first combining portion 321 and the second combining portion 322, the tightening units 325 will tightly resist against lateral sides of the contact unit 324 and the first combining portion 321. In addition, two washers 326 are respectively disposed on two ends of the contact unit 32. One of the two washers 326 is positioned between the first combining portion 321 and the contact unit 324; whereas the other washer 326 is positioned between the contact unit 324 and the second combining portion 322 so as to retain the stability of the first combining portion 321 and the second combining portion 322 when first combining portion 321 and the second combining portion 322 are clampingly engaged with the contact unit 324.

Referring to FIGS. 6 to 9, the use of the body 1 of the present invention is illustrated. When the body 1 is fixed to the glass doorplate 4, based on the size of the track device 5, by adjusting the rolling portion 32, the distance between the first combining portion 321 and the second combining portion 322 is adjustable so that the track device 5 is exactly matched to the distance therebetween and the contact unit 324 resists against the track device 5. Thus other than moving the doorplate transversally, the body 1 are more flexible in assembly with various kinds of doorplates.

Figure 10:
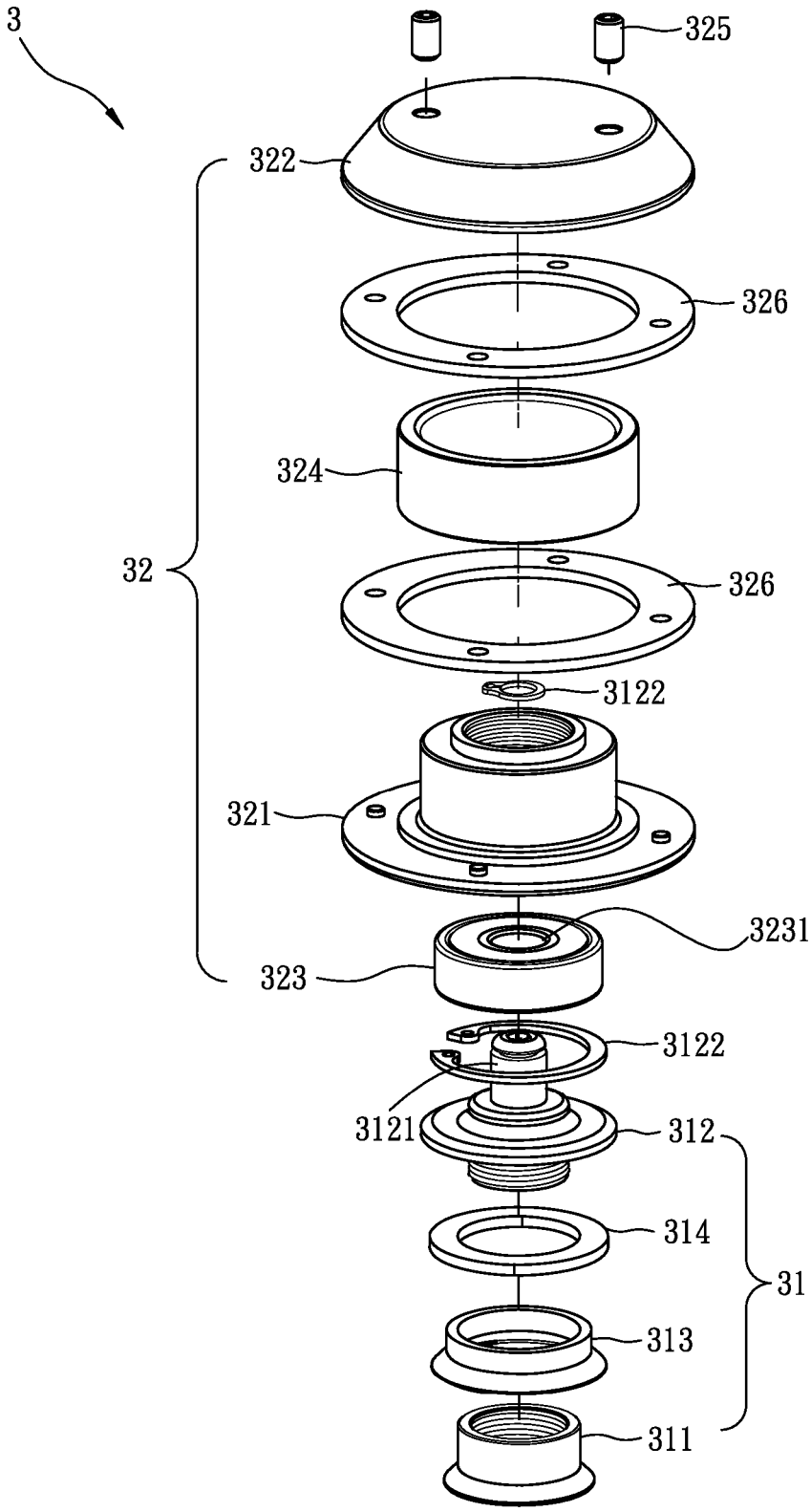
FIGS. 10 and 11 are schematic views showing the second embodiment of the sliding assembly for a transversal sliding door of the present invention.
Figure 11:
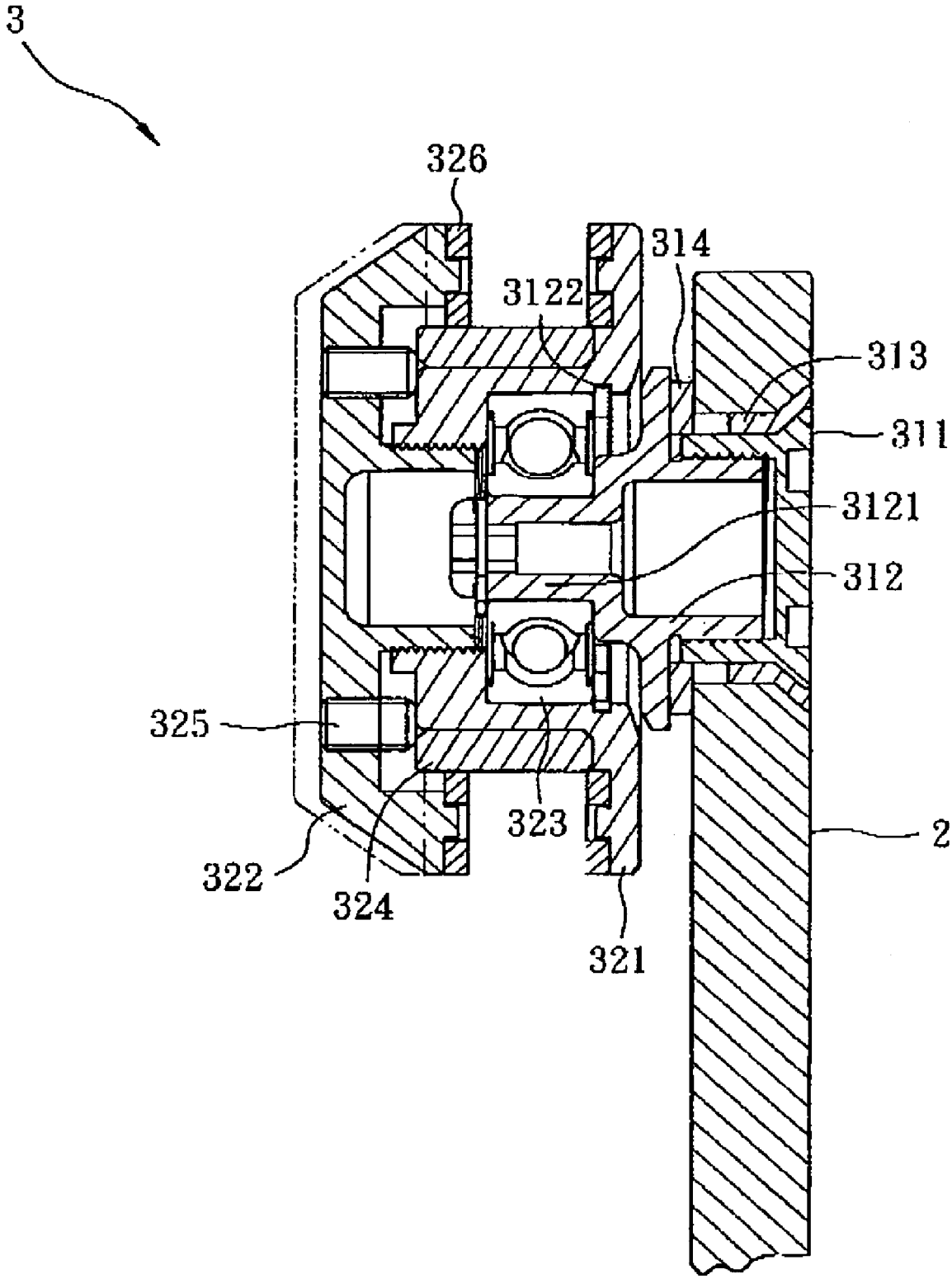
Figure 12:
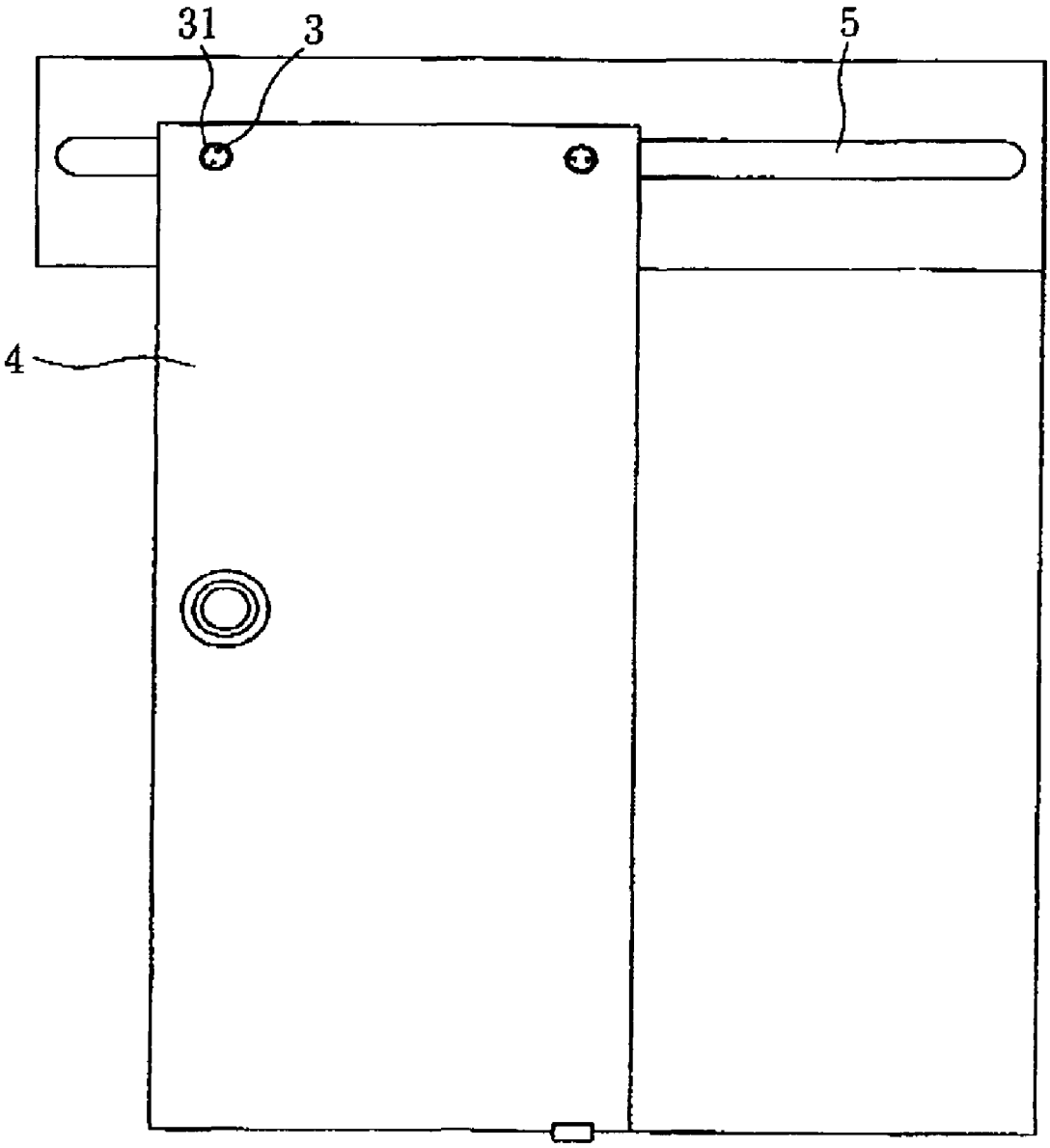
FIG. 12 shows the third embodiment about the sliding assembly for a transversal sliding door of the present invention.

Referring to FIGS. 10 to 12, other embodiment about the present invention is illustrated. In this embodiment, those identical to the above embodiment will not be further described herein. Only those different from above embodiment are described.

The second embodiment is illustrated in FIGS. 10 and 11, the retaining unit 311 has a tapered end. The corresponding portion of the positioning unit 2 for assembling the retaining unit 311 is also tapered for corresponding to the shape of the retaining unit 311. Thereby the retaining unit 311 is reduced into the positioning unit 2 without clamping. Thus, the retaining unit 311 can be installed to the glass doorplate 4 which had a countersunk.

The third embodiment of the present invention is illustrated in FIG. 12, another installation of the body 1 of the present invention is illustrated. In this embodiment, the rolling portion 32 of the sliding device 3 is directly assembled to the glass doorplate 4. The contact unit 324 is rotatably installed to a track device 5 which has a form of a slot.

From above mentioned applications about the body 1, it is known that the sliding device 3 is pivoted to the positioning unit 2 so that it can move transversally. The elements of the positioning unit 2 and sliding device 3 being at the same side of a doorplate cause that the center of gravity is retained at a central line of a doorplate. No danger of turning over occurs. Besides, in the body 1, the distance between the first combining portion 321 and the second combining portion 322 is adjustable based on the object to be engaged with the rolling portion 32. Thus a greater margin is provided for installation of the body 1. Thereby the safety and installation margin of the present invention are high.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A sliding assembly having a body for a transversal sliding door the body comprising:

a positioning unit and a sliding device assembled with the positioning unit; one end of the positioning unit served to assemble with a doorplate; and another end of the positioning unit served to assemble with the sliding device;

the sliding device including a retaining portion and a rolling portion assembled with the retaining portion; the retaining portion including a retaining unit and a retaining seat secured with the retaining unit for assembling with the rolling portion; the retaining unit and the retaining seat respectively located on two opposite sides of the positioning unit;

the rolling portion including a first combining portion rotatably engaging with the retaining seat, a wheel shaft rotatably engaging with the retaining seat and received in the first combining portion; a second combining portion threadedly engaged with the first combining portion;

and a contact unit clampingly and sandwichedly disposed between the first combining portion and the second combining portion; wherein when the doorplate is pushed, the contact unit is rotatably driven by the doorplate for simultaneously driving the first combining portion, the second combining portion, and the wheel shaft to rotate relative to the retaining seat, thereby driving the doorplate to move transversally; the rolling portion vertically aligned with the doorplate.

2. The sliding assembly having a body for a transversal sliding door as claimed in claim 1, wherein the wheel shaft has a through hole axially defined therein; a retaining rod extending from one end of the retaining seat for passing through the through hole; a buckle assembled to a distal end of the retaining rod for limiting the wheel shaft on the retaining rod.

3. The sliding assembly having a body for a transversal sliding door as claimed in claim 1, wherein the sliding device of the body is adapted to be directly assembled to the doorplate without using the positioning unit.

4. The sliding assembly having a body for a transversal sliding door as claimed in claim 1, wherein the positioning unit is adapted to be parallely installed to the doorplate.

5. A sliding assembly having a body for a transversal sliding door; the body comprising a positioning unit and a sliding device assembled to the positioning unit; one end of the positioning unit served to assemble with a doorplate; and another end of the positioning unit served to assemble with the sliding device;

the sliding device including a retaining portion and a rolling portion assembled with the retaining portion; the retaining portion including a retaining unit and a retaining seat secured with the retaining unit for assembling with the rolling portion; the retaining unit and the retaining seat respectively located on two opposite sides of the positioning unit;

the rolling portion including a first combining portion rotatably engaging with the retaining seat, a wheel shaft rotatably engaging with the retaining seat and received in the first combining portion, a second combining portion screwedly engaged with the first combining portion; and a contact unit clampingly sandwiched between the first combining portion and the second combining portion; wherein when the doorplate is pushed, the contact unit is rotatably driven by the doorplate for simultaneously driving the first combining portion, the second combining portion, and the wheel shaft to rotate relative to the retaining seat, thereby driving the doorplate to move transversally; and each diameter of the first combining portion and the second combining portion of being greater than that of the contact unit clamping each other, such that the first combining portion and the second combining portion are screwedly and clamping engaged; thus a distance between the first combining portion and the second combining portion is adjustable based on a size of the contact unit disposed in between the first combining portion and the second combining portion so as to promote the usage.

6. The sliding assembly having a body for a transversal sliding door as claimed in claim 5, wherein one side of the second combining portion has at least one tightening unit mounted therein for resisting against the first combining portion and the contact unit; wherein when the distance between the first combining portion and the second combining portion is adjusted, the tightening unit tightly resisted against the first combining portion and thus the first combining portion and the second combining portion are firmly secured.

7. The sliding assembly having a body for a transversal sliding door as claimed in claim 5, wherein the retaining unit has a tapered end for correspondingly engaging with the positioning unit.

8. The sliding assembly having a body for a transversal sliding door as claimed in claim 5, wherein the wheel shaft has a through hole axially defined therein; a retaining rod extending from one end of the retaining seat for passing through the through hole; and each of an upper end and a lower end of the retaining rod assembled with a buckle for limiting the wheel shaft on the retaining rod.

9. The sliding assembly having a body for a transversal sliding door as claimed in claim 5, wherein the sliding device of the body is adapted to be directly assembled to the doorplate without using positioning unit.

10. The sliding assembly having a body for a transversal sliding door as claimed in claim 5, further comprising two washers respectively disposed on two ends of the contact unit, one of the two washers positioned between the first combining portion and the contact unit and the other washer positioned between the contact unit and the second combining portion so as to retain stability of the first combining portion 321 and the second combining portion when the first combining portion and the second combining portion clampingly engaged with the contact unit.

* * * * *